US009349512B2

(12) United States Patent
Hahn et al.

(10) Patent No.: US 9,349,512 B2
(45) Date of Patent: May 24, 2016

(54) MULTI-LAYERED CHIP ELECTRONIC COMPONENT

(71) Applicant: SAMSUNG ELECTRO-MECHANICS CO., LTD., Gyunggi-do (KR)

(72) Inventors: Jin Woo Hahn, Gyunggi-do (KR); Myeong Gi Kim, Gyunggi-do (KR); Sung Yong An, Gyunggi-do (KR); Ic Seob Kim, Gyunggi-do (KR); Byeong Cheol Moon, Gyunggi-do (KR)

(73) Assignee: Samsung Electro-Mechanics Co., Ltd., Suwon, Gyunggi-do (KR)

( * ) Notice: Subject to any disclaimer, the term of this patent is extended or adjusted under 35 U.S.C. 154(b) by 0 days.

(21) Appl. No.: 13/633,544

(22) Filed: Oct. 2, 2012

(65) Prior Publication Data

US 2013/0335184 A1 Dec. 19, 2013

(30) Foreign Application Priority Data

Jun. 14, 2012 (KR) ..... 10-2012-0063795

(51) Int. Cl.

| | |
|---|---|
| ***H01F 5/00*** | (2006.01) |
| ***H01F 27/28*** | (2006.01) |
| ***H01F 3/14*** | (2006.01) |
| ***H01F 17/00*** | (2006.01) |
| *H01F 27/29* | (2006.01) |

(52) U.S. Cl.

CPC ..... *H01F 3/14* (2013.01); *H01F 17/0013* (2013.01); *H01F 17/0033* (2013.01); *H01F 27/292* (2013.01)

(58) Field of Classification Search

CPC . H01F 5/003; H01F 17/0006; H01F 27/2804; H01F 17/0033; H01F 17/0013; H01F 27/292

USPC ..... 336/200, 223, 233, 234, 83

See application file for complete search history.

(56) References Cited

U.S. PATENT DOCUMENTS

| | | | | |
|---|---|---|---|---|
| 7,719,398 | B2 * | 5/2010 | Tsuzuki | 336/200 |
| 2006/0152325 | A1 * | 7/2006 | Nakao et al. | 336/223 |
| 2007/0182519 | A1 * | 8/2007 | Tsuzuki et al. | 336/200 |
| 2008/0012679 | A1 * | 1/2008 | Okabe et al. | 336/200 |
| 2009/0051476 | A1 * | 2/2009 | Tada et al. | 336/105 |
| 2010/0033286 | A1 * | 2/2010 | Katayama et al. | 336/200 |

(Continued)

FOREIGN PATENT DOCUMENTS

| | | | |
|---|---|---|---|
| JP | 2002-093623 | A | 3/2002 |
| JP | 2002-299123 | A | 10/2002 |

(Continued)

*Primary Examiner* — Mangtin Lian

(74) *Attorney, Agent, or Firm* — McDermott Will & Emery LLP

(57) ABSTRACT

There is provided a multi-layered chip electronic component including: a multi-layered body including a 2016-sized or less and a plurality of magnetic layers; conductive patterns electrically connected in a stacking direction to form coil patterns, within the multi-layered body; and non-magnetic gap layers formed over a laminated surface of the multi-layered body between the multi-layered magnetic layers and having a thickness Tg in a range of 1 μm≤Tg≤7 μm, wherein the number of non-magnetic gap layers may have the number of gap layers in a range between at least four layers among the magnetic layers and a turns amount of the coil pattern.

22 Claims, 14 Drawing Sheets

(56) References Cited

U.S. PATENT DOCUMENTS

| | | | | |
|---|---|---|---|---|
| 2011/0128109 | A1* | 6/2011 | Tada et al. | 336/200 |
| 2011/0279213 | A1* | 11/2011 | Tsuduki et al. | 336/200 |
| 2012/0286917 | A1* | 11/2012 | Uchida et al. | 336/200 |

FOREIGN PATENT DOCUMENTS

| | | | |
|---|---|---|---|
| JP | 2004-342963 | A | 12/2004 |
| JP | 2006-216916 | A | 8/2006 |
| JP | 2008-130736 | A | 6/2008 |

* cited by examiner

MULTI-LAYERED CHIP ELECTRONIC COMPONENT

CROSS-REFERENCE TO RELATED APPLICATIONS

This application claims the priority of Korean Patent Application No. 10-2012-0063795 filed on Jun. 14, 2012, in the Korean Intellectual Property Office, the disclosure of which is incorporated herein by reference.

BACKGROUND OF THE INVENTION

1. Field of the Invention

The present invention relates to a multi-layered chip electronic component.

2. Description of the Related Art

An inductor, a multi-layered chip component, is a representative passive element capable of removing noise by configuring an electronic circuit, together with a resistor and a capacitor.

A multi-layered chip type inductor may be manufactured by printing and stacking conductive patterns so as to form a coil in a magnetic substance. The multi-layered chip type inductor has a structure in which a plurality of magnetic layers on which conductive patterns are formed are stacked. Internal conductive patterns within the multi-layered chip type inductor are sequentially connected by via electrodes formed in each magnetic layer to form a coil structure within a chip to implement targeted inductance and impedance characteristics.

Recently, as multi-layered chip type inductors have been miniaturized, the multi-layered chip type inductors have had a defect of reduced inductance due to DC bias. In order to suppress the reduction in inductance due to DC bias, the miniaturized power inductor is formed with a non-magnetic gap layer to suppress magnetic saturation.

The forming of the non-magnetic gap layer in the multi-layered chip type inductor is to use an effect of reducing the overall effective permeability of the multi-layered body in the multi-layered chip type inductor to delay magnetization.

Here, effective permeability depends on a volume ratio of a magnetic substance to a non-magnetic substance. When a thickness of the non-magnetic gap layer is increased and the number of layers thereof is reduced under the precondition that the non-magnetic gap layer has the same volume, a magnetic flux forms a local loop in the magnetic layers around the conductive patterns to partially cause a flux offset, having a bad effect on the DC bias characteristics, and when the thickness of non-magnetic gap layer is thin and the number of layers thereof is increased, the local loop can be suppressed as possible.

Therefore, a development of the multi-layered chip type inductor with excellent DC bias characteristics while implementing miniaturization and securing sufficient capacity, may be undertaken by adjusting the thickness of the non-magnetic gap layer.

PRIOR ART DOCUMENTS

Japanese Patent Laid-Open Publication No. 2008-130736
Japanese Patent No. 4725120

SUMMARY OF THE INVENTION

An aspect of the present invention provides a multi-layered chip component having excellent DC bias characteristics while implementing miniaturization and securing sufficient capacity, by adjusting a thickness of a non-magnetic layer to be thin.

According to an aspect of the present invention, there is provided a multi-layered chip electronic component, including: a multi-layered body including a plurality of magnetic layers; conductive patterns electrically connected in a stacking direction to form coil patterns, within the multi-layered body; and non-magnetic gap layers formed over a laminated surface of the multi-layered body between the multi-layered magnetic layers and having a thickness Tg in a range of 1 μm≤Tg≤7 μm, wherein the number of non-magnetic gap layers has a range between at least four layers and a turns amount of the coil pattern.

When a thickness of an active region layer defined by forming the conductive patterns in the stacking direction is defined as Ta and the overall thickness of the non-magnetic gap layer is defined as Tg,tot, Tg,tot:Ta may satisfy 0.1≤Tg,tot:Ta≤0.5.

The non-magnetic gap layer may be formed of a dielectric composition.

The magnetic layer may include a first magnetic layer formed to be a common layer with the conductive pattern and a second magnetic layer including via electrodes electrically connecting the conductive patterns.

The first magnetic layer may include the non-magnetic gap layer.

The second magnetic layer may include the non-magnetic gap layer.

The non-magnetic gap layer may be disposed between the conductive patterns.

A length of the multi-layered body may be 2.1 mm or less and a width of the multi-layered body may be 1.7 mm or less.

A length and a width of the multi-layered chip electronic component may have a range of 2.0±0.1 mm and 1.6±0.1 mm, respectively.

According to another aspect of the present invention, there is provided a multi-layered chip electronic component, including: a multi-layered body including a plurality of magnetic layers; conductive patterns disposed between the plurality of magnetic layers and electrically connected in a stacking direction to form coil patterns; and non-magnetic gap layers having a plurality of layers within the multi-layered body and each having a thickness Tg in a range of 1 μm to 7 μm.

The non-magnetic gap layer may be formed over a laminated surface of the multi-layered body.

The non-magnetic gap layer may be formed over a laminated surface of the multi-layered body and the number of non-magnetic gap layers may be four layers or more.

The non-magnetic gap layer may have the number of layers in a range between at least four layers among the magnetic layers and the turns amount of the coil pattern.

When a thickness of an active region layer defined by forming the conductive patterns in the stacking direction is defined as Ta and the overall thickness of the non-magnetic gap layer is defined as Tg,tot, Tg,tot:Ta may satisfy 0.1≤Tg,tot:Ta≤0.5.

The non-magnetic gap layer may be formed of a dielectric composition that suppresses a diffusion of a component of the magnetic layer.

The dielectric composition may include one or more composition selected from $TiO_2$, $ZrO_2$, $Al_2O_3$, and $ZnTiO_3$.

The magnetic layer may include a first magnetic layer formed to be a common layer with the conductive pattern and a second magnetic layer including via electrodes.

The first magnetic layer may include the non-magnetic gap layer.

The second magnetic layer may include the non-magnetic gap layer.

The non-magnetic gap layer may be disposed between the conductive patterns.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
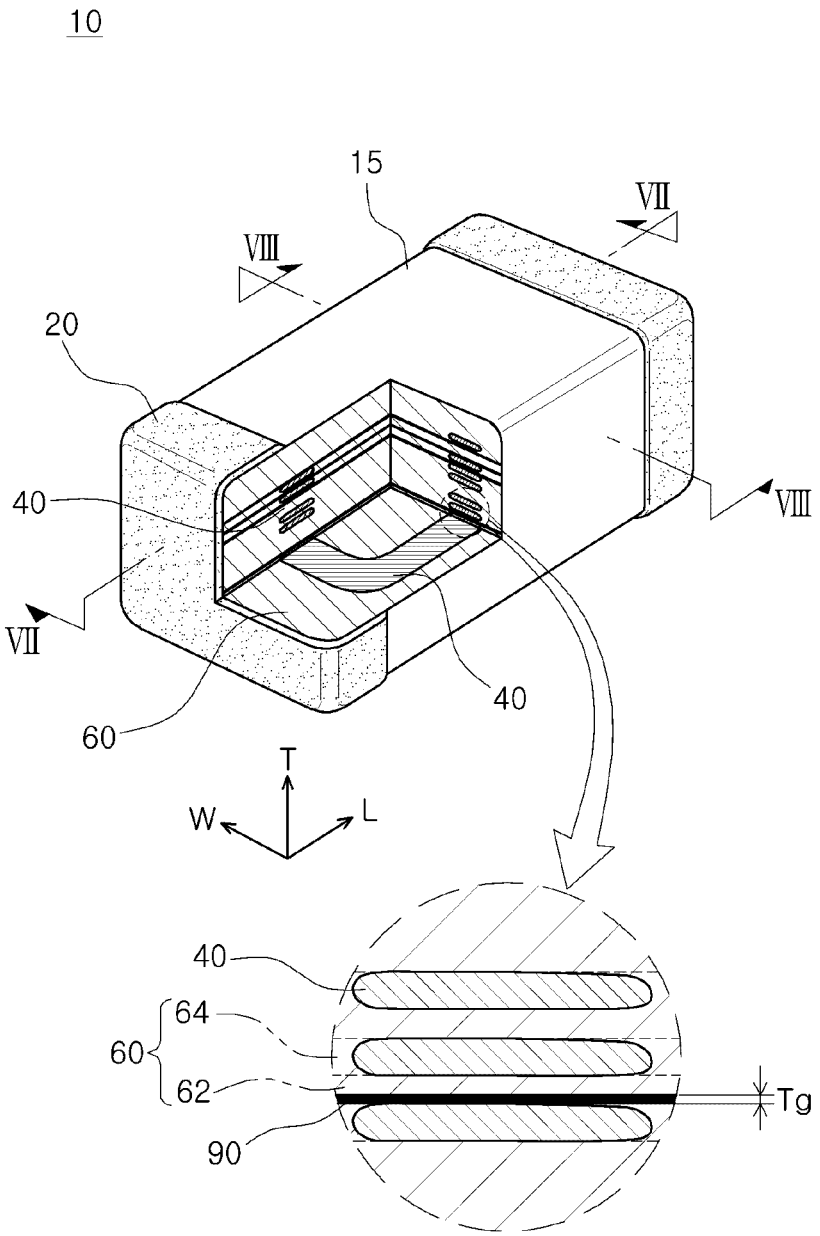
FIG. 1 is a partially cutaway perspective view of a multi-layered chip type inductor according to an embodiment of the present invention.

Embodiments of the present invention will now be described in detail with reference to the accompanying drawings. However, it should be noted that the spirit of the present invention is not limited to the embodiments set forth herein and that those skilled in the art and understanding the present invention can could easily accomplish retrogressive inventions or other embodiments included in the spirit of the present invention by the addition, modification, and removal of components within the same spirit, but those are to be construed as being included in the spirit of the present invention.

Further, like reference numerals will be used to designate like components having similar functions throughout the drawings within the scope of the present invention.

A multi-layered chip electronic component according to an embodiment of the present invention may be appropriately applied as a chip inductor in which conductive patterns are formed on magnetic layers, chip beads, a chip filter, and the like.

Hereinafter, embodiments of the present invention will be described with reference to a multi-layered chip type inductor.

Multi-Layered Chip Type Inductor

Figure 2A:
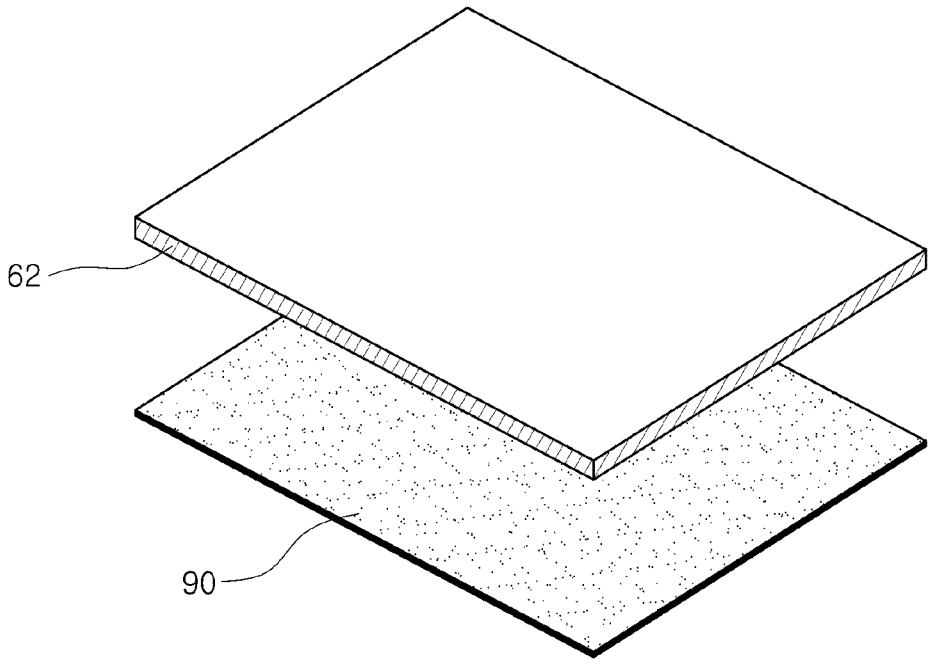
FIGS. 2A to 2C are schematic diagrams showing a first embodiment forming a non-magnetic gap layer.
Figure 2B:
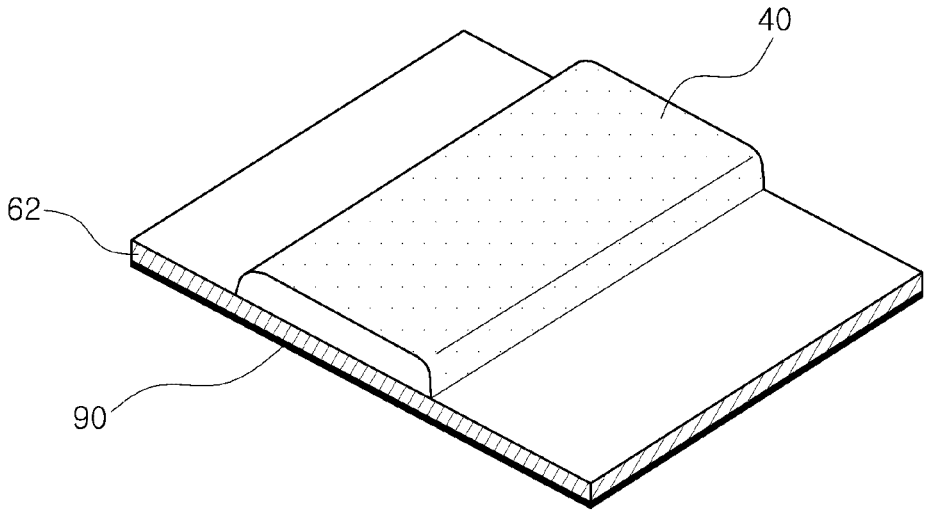
Figure 2C:
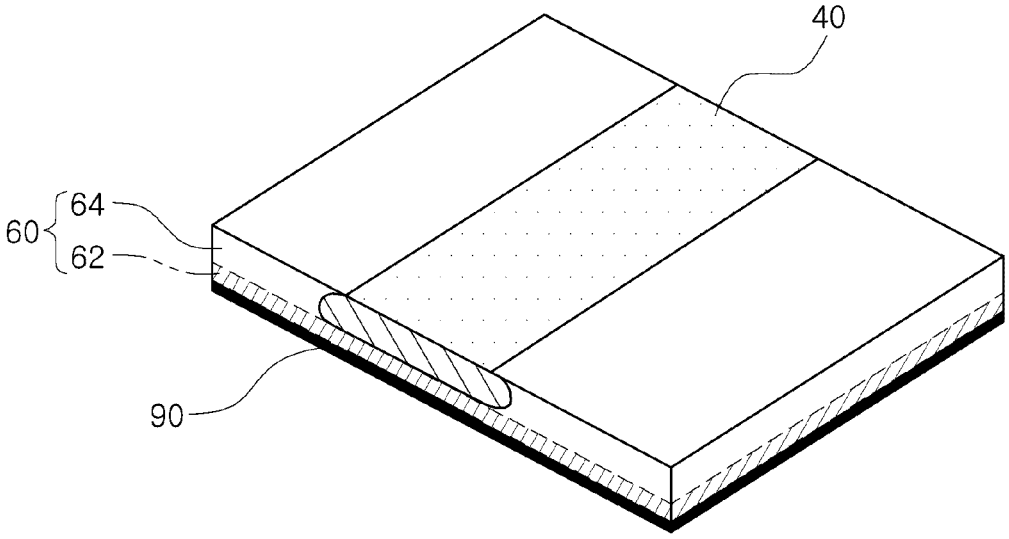
Figure 3A:
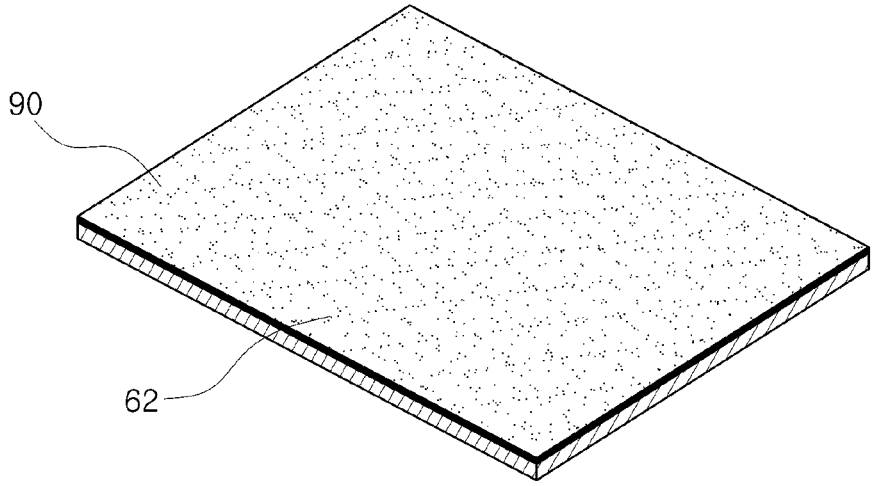
FIGS. 3A to 3C are schematic diagrams showing a second embodiment forming a non-magnetic gap layer.
Figure 3B:
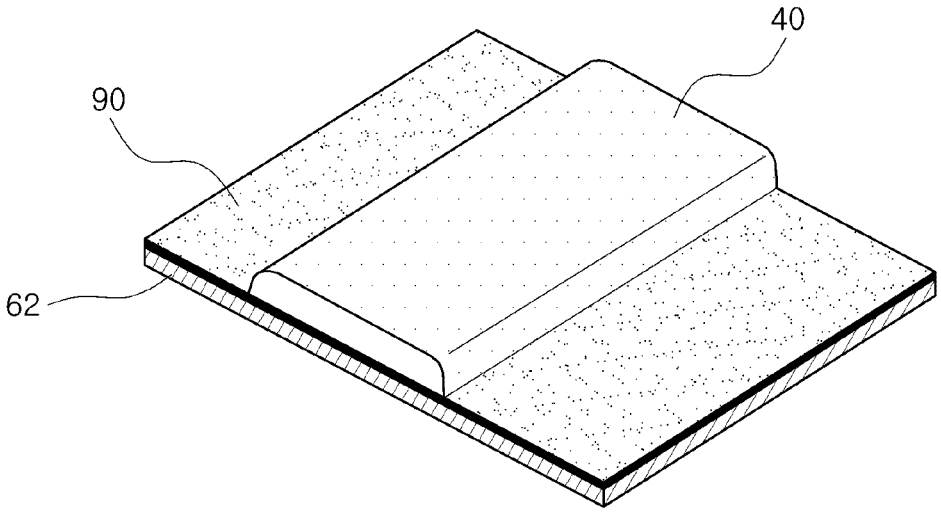
Figure 3C:
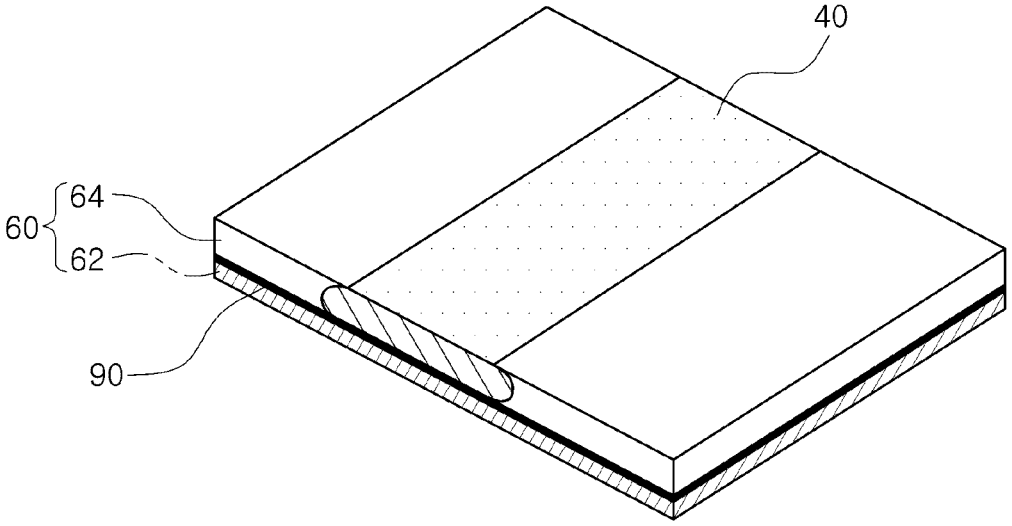
Figure 4A:
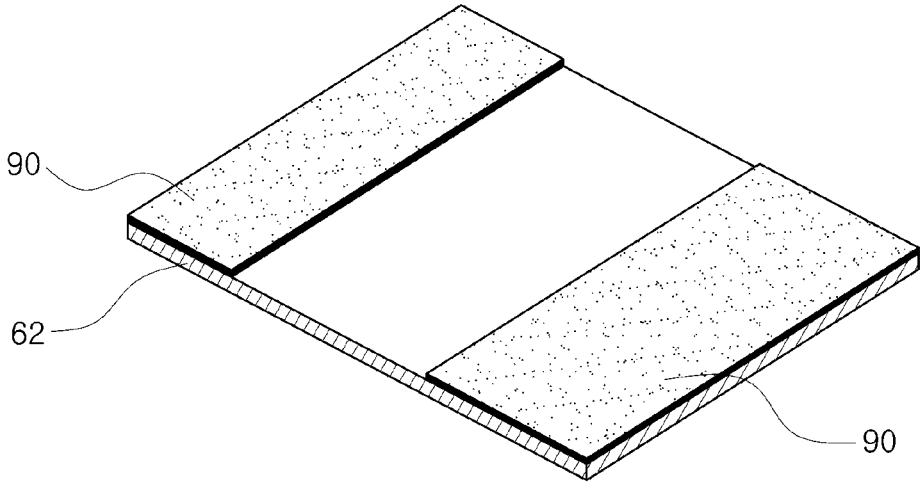
FIGS. 4A to 4C are schematic diagrams showing a third embodiment forming a non-magnetic gap layer.
Figure 4B:
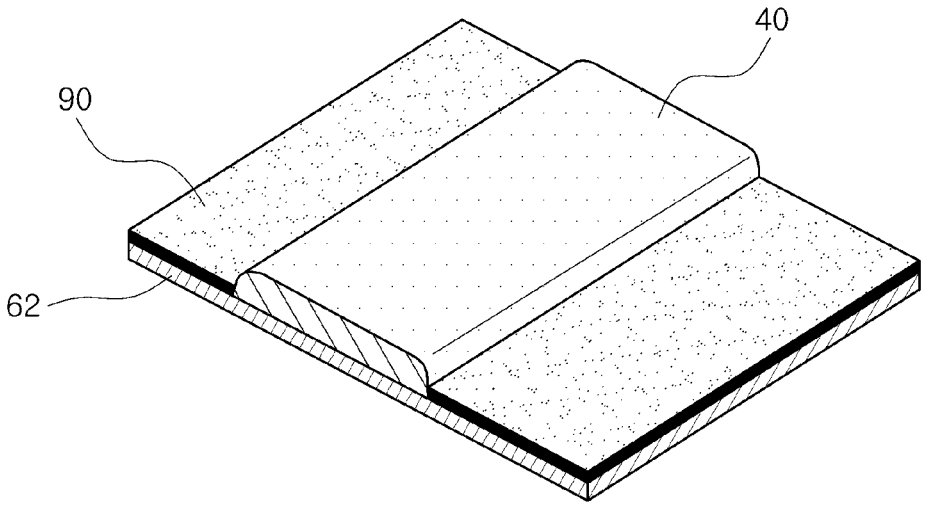
Figure 4C:
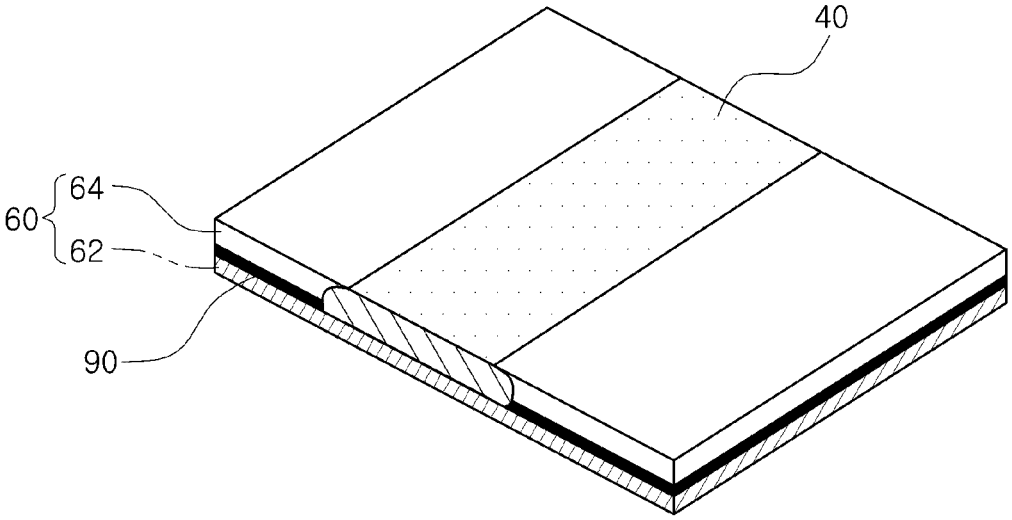

FIG. 1 is a partially cutaway perspective view of a multi-layered chip type inductor according to an embodiment of the present invention, FIGS. 2A to 2C are schematic diagrams showing a first embodiment forming a non-magnetic gap layer, FIGS. 3A to 3C are schematic diagrams showing a second embodiment forming a non-magnetic gap layer, and FIGS. 4A to 4C are schematic diagrams showing a third embodiment forming a non-magnetic gap layer.

Referring to FIGS. 1 to 4, a multi-layered chip type inductor 10 may include a multi-layered body 15, conductive patterns 40, magnetic layers 62 and 64, a non-magnetic gap layer 90, and external electrodes 20.

The multi-layered body 15 may be manufactured by printing the conductive patterns 40 on magnetic green sheets and stacking and sintering the magnetic green sheets on which the conductive patterns 40 are formed.

The multi-layered body 15 may have a hexahedral shape. When the magnetic green sheets are multi-layered and sintered in a chip shape, the multi-layered body 15 may not form a hexahedral shape having completely straight lines, due to a sintering shrinkage of ceramic powder particles. However, the multi-layered body 15 may be formed to have a substantially hexahedral shape.

When defining hexahedral directions in order to clearly describe embodiments of the present invention, L, W, and T shown in FIG. 1 represent a length direction, a width direction, and a thickness direction, respectively. Here, the thickness direction may be used to have the same meaning as a direction in which magnetic layers are stacked.

An embodiment of FIG. 1 shows the chip inductor 10 having a rectangular parallelepiped shape in which a length direction is larger than a width or thickness direction.

A size of the multi-layered chip type inductor 10 according to the embodiment of the present invention may have a length and a width of the multi-layered body including the external electrodes 20, respectively having a range of 2.0±0.1 mm and 1.6±0.1 mm (2016 sized), and may be formed to be 2016-sized or less (that is, a length of the multi-layered body is 2.1 mm or less and a width of the multi-layered body is 1.7 mm or less).

The first and second magnetic layers 62 and 64 are formed of a Ni—Cu—Zn-based substance, a Ni—Cu—Zn—Mg-based substance, a Mn—Zn-based substance, a ferrite-based substance, but the embodiment of the present invention is not limited thereto.

Here, the magnetic layers 62 and 64 according to the embodiment of the present invention may include the first magnetic layer 64 forming a common layer with the conductive pattern 40 after being sintered and the second magnetic layer 62 interposed between the conductive patterns 40 adjacent to each other in the stacking direction within the multi-layered body 15.

The second magnetic layer 62 may be a magnetic green sheet before being sintered and the first magnetic layer 64 may be formed by applying or printing the magnetic substance on the magnetic green sheet to have a thickness equal to that of the conductive pattern 40.

The first magnetic layer 64 and the second magnetic layer 62 may be formed separately. However, the plurality of first and second magnetic layers 64 and 62 configuring the multi-layered body 15 are in a sintered state and boundaries between the adjacent first and second magnetic layers 64 and 62 may be integrated and thus, may be difficult to be confirmed without using a scanning electron microscope (SEM).

The non-magnetic gap layer 90 may reduce the effective permeability of the magnetic layers 62 and 64 of the multi-layered body 15 to delay the magnetization. When the magnetic layers 62 and 64 are formed of the Ni—Cu—Zn-based ferrite, the magnetic layers 62 and 64 may use a dielectric composition so as not to change the non-magnetic gap layer 90 into a property of the magnetic substance due to diffusion between the magnetic substance and the non-magnetic substance during the high-temperature sintering process.

Here, the dielectric composition may be selected to have one or more compositions selected from $TiO_2$, $ZrO_2$, $Al_2O_3$, and $ZnTiO_3$.

By selecting the dielectric composition, the thickness of the non-magnetic gap layer 90 may be relatively thin and the number of layers of the non-magnetic gap layer 90 may be increased. As such, when the thickness of the non-magnetic gap layer 90 is thin and the number of layers thereof is increased, the DC bias characteristics may be improved by preventing magnetic flux from forming a local loop in the magnetic layers around the conductive patterns 40.

Hereinafter, a formation appearance of the non-magnetic gap layer 90 will be described with reference to FIGS. 2 to 4.

Referring to FIGS. 2A to 2C, the ferrite green sheet 62 and the non-magnetic sheet 90 are stacked (FIG. 2A), the conductive pattern 40 is printed on the ferrite green sheet 62 and dried (FIG. 2B), and the separate planarized magnetic layer 64 differentiated from the ferrite green sheet 62 is formed by printing a ferrite slurry as a paste in a space next to the conductive pattern 40 so as to form a common layer with the conductive pattern 40 (FIG. 2C). Here, the ferrite green sheet 62, the conductive pattern 40, and the planarized magnetic layer 64 form a single multi-layered carrier 60. The multi-layered carrier 60 on which the non-magnetic sheet 90 is formed is multi-layered together with the multi-layered carrier 60 on which another non-magnetic sheet is formed or the multi-layered carrier 60 on which the non-magnetic sheet is not formed, to thus form the non-magnetic gap layer within the multi-layered body 15. Here, the formation position of the non-magnetic sheet 90 may also be in the top or bottom of the ferrite green sheet 62 in the stacking direction.

Referring to FIGS. 3A to 3C, in order to form the non-magnetic gap layer, a single layer may be formed by applying the non-magnetic substance having the dielectric composition to the ferrite green sheet 62 (FIG. 3A), the conductive pattern 40 may be formed thereon (FIG. 3B), and the planarized magnetic layer 64 may be formed by printing the ferrite slurry as the paste at the space next to the conductive pattern 40.

In addition, referring to FIGS. 4A to 4C, in order to form the non-magnetic gap layer, a single layer may be formed by applying the non-magnetic substance having the dielectric composition to the ferrite green sheet 62 but printing the non-magnetic substance while emptying the space in which the conductive pattern 40 is formed (FIG. 4A), the conductive pattern 40 may be formed in the space emptied for forming the conductive pattern (FIG. 4B), and the planarized magnetic layer 64 may be formed by printing the ferrite slurry as the paste in the space next to the conductive pattern 40 (FIG. 4C). Here, the applying of the non-magnetic substance may form the separate planarized magnetic layer on the non-magnetic substance layer having approximately the same thickness as the conductive pattern 40 by printing the conductive pattern 40 on the ferrite green sheet 62 and printing the non-magnetic substance in the space next to the conductive pattern 40 to have a thickness thinner than that of the conductive pattern 40.

The conductive patterns 40 may be formed by printing a conductive paste using silver (Ag) as a main component at a predetermined thickness. The conductive patterns 40 may be electrically connected to the external electrodes 20 that are formed at both ends of the ceramic body.

The external electrodes 20 are formed at both ends of the ceramic body of the ceramic body 15 and may be formed by electroplating an alloy selected from Cu, Ni, Sn, Ag, and Pd. However, the embodiment of the present invention is not limited to these substances.

The conductive pattern 40 may include leads 48 that are electrically connected to the external electrodes 20.

Figure 5:
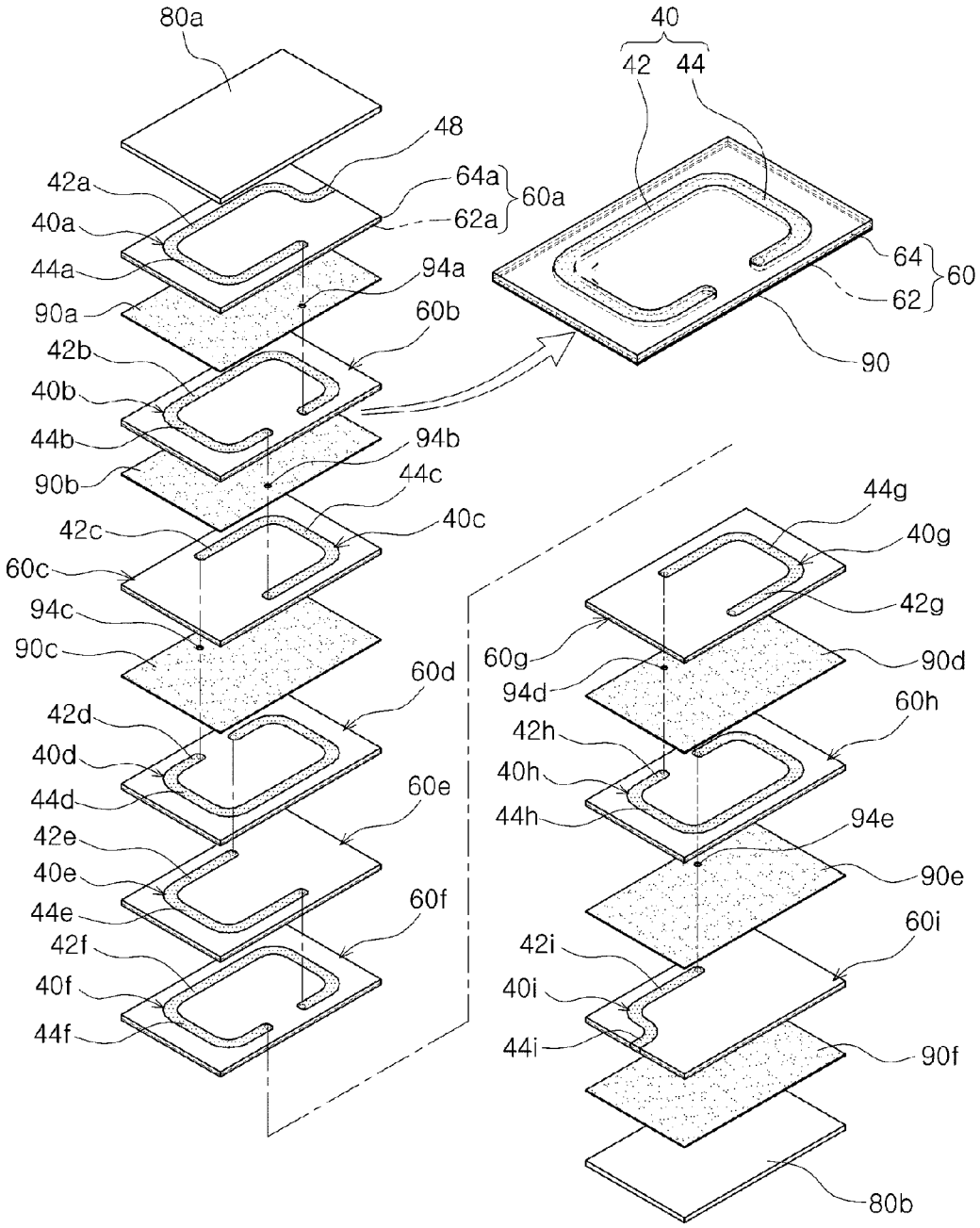
FIG. 5 is a schematically exploded perspective view of a multi-layered appearance of the multi-layered chip type inductor of FIG. 1.
Figure 6:
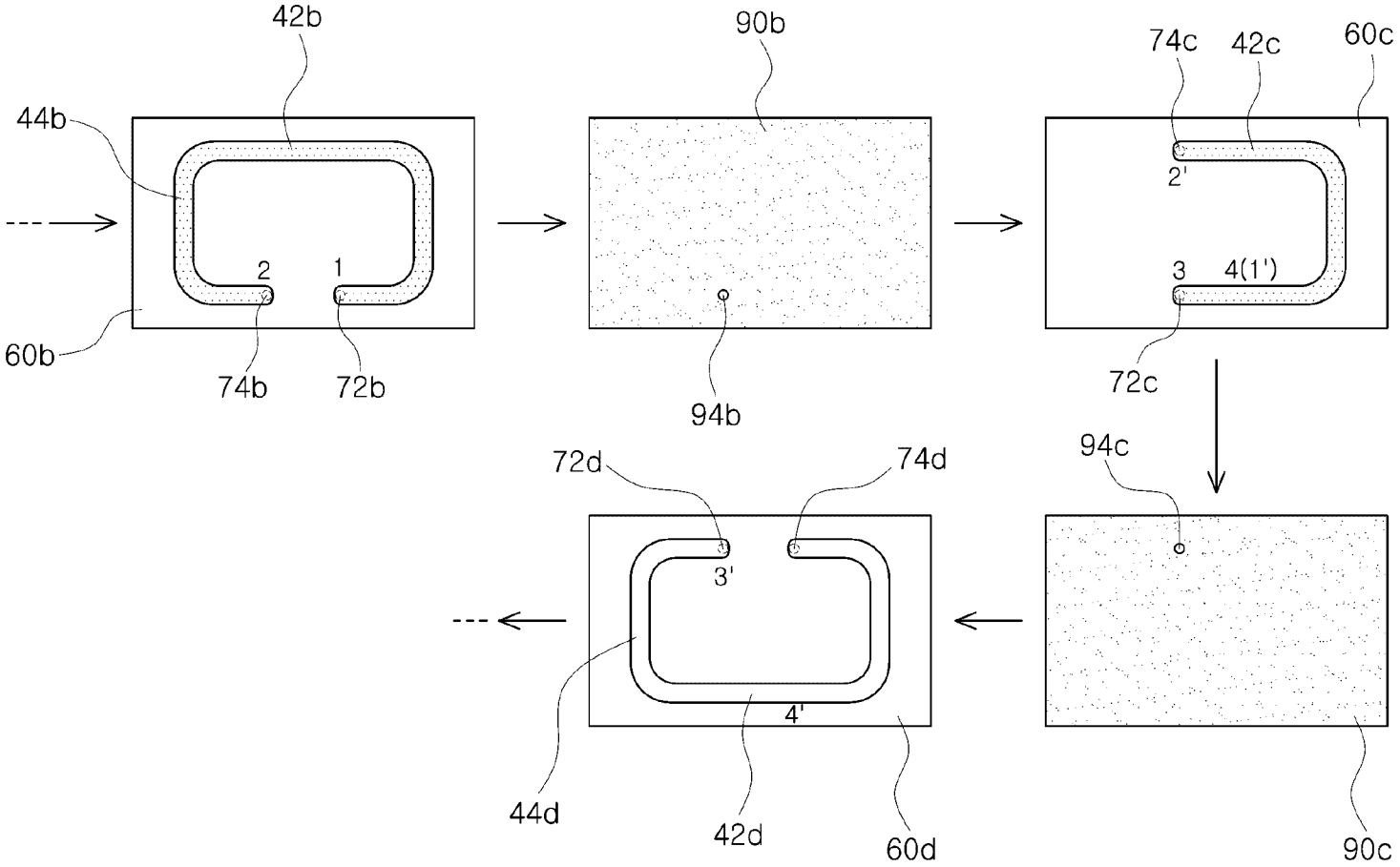
FIG. 6 is a schematic plan view showing an appearance of conductive patterns and a non-magnetic gap layer formed on the magnetic layers of FIG. 1.

FIG. 5 is a schematically exploded perspective view of a multi-layered appearance of the multi-layered chip type inductor of FIG. 1, while FIG. 6 is a schematic plan view showing an appearance of conductive patterns and non-magnetic gap layers formed on the magnetic layers of FIG. 1.

Referring to FIGS. 5 and 6, a conductive pattern 40*a* on a single multi-layered carrier 60*a* includes a conductive pattern 42*a* in a length direction and a conductive pattern 44*a* in a width direction. The conductive pattern 40*a* is electrically connected with a conductive pattern 40*b* on another multi-layered carrier 60*b* having a magnetic layer 62*a* disposed therebetween through via electrodes 72 and 74 formed on the magnetic layer 62*a* to form the coil patterns 50 in a stacking direction.

In this case, when a non-magnetic gap layer 90*b* is present between the multi-layered carrier 60*b* and another multi-layered carrier 60*c*, the stacked carriers 60*b* and 60*c* are connected to each other by being electrically connected by a via electrode 74*b* formed on the magnetic layer 62*b* and a via electrode 94*b* formed on the non-magnetic gap layer 90*b*.

All the coil patterns 50 according to the embodiment of the present invention have a turns amount of 6.5 times, but the embodiment of the present invention is not limited thereto. In order for the coil patterns 50 to have a turns amount of 6.5 times, nine stacked carriers 60*a*, 60*b*, . . . , 60*i* in which conductive patterns 40*a*, 40*b*, . . . , 40*i* are formed are disposed between top and bottom magnetic layers 80*a* and 80*b* forming a cover layer.

In addition, the embodiment of the present invention describes the case in which six non-magnetic gap layers 90*a*, 90*b*, . . . , 90*f* are formed between the top and bottom magnetic layers 80*a* and 80*b*, but the present invention is not limited thereto.

The embodiment of the present invention requires at least two stacked carriers formed with the conductive patterns 42*a* and 42*b* so as to form the coil pattern 50 having a turns amount of one time, but is not limited thereto and therefore, may require a different number of stacked carriers according to a shape of the conductive pattern.

A thickness Tg of the non-magnetic gap layer 90 may be manufactured as a thin layer having a thickness of 1 μm to 7 μm. Therefore, a plurality of thin non-magnetic gap layers 90 may be disposed to improve the DC bias characteristics, and Tg and the number of gap layers may be changed according to the requested electrical performance.

When Tg is less than 1 μm, defects may occur on the sheet or the non-magnetic substance layer to be formed as the non-magnetic gap layer 90 and thus, the DC bias characteristics may be degraded. In addition, when Tg exceeds 7 μm, it is difficult to implement capacity.

The non-magnetic gap layer 90 may have the number of gap layers in a range between at least four layers and the turns amount of the coil pattern 50.

The non-magnetic gap layer 90 may be formed over the laminated surface of the multi-layered body 15 between the multi-layered magnetic layers. Here, the forming of the non-magnetic gap layer 90 over the laminated surface of the multi-layered body 15 indicates the case in which the non-magnetic gap layer 90 is entirely formed between the multi-layered magnetic layers such that the cross section thereof may be provided as the non-magnetic gap layer 90 between the multi-layered magnetic layers in both the length direction and the width direction (see FIGS. 7 and 8) and does not indicate the case in which the non-magnetic gap layer 90 is formed only in a part of a region between the magnetic layers.

In addition, even when the non-magnetic gap layer 90 partially includes the via electrodes or defects such as holes occurring during the process, the non-magnetic gap layer 90 may be considered to be formed over the laminated surface of the multi-layered body 15.

When the number of layers of the non-magnetic gap layer 90 is less than four layers, the capacity may be changed according to temperature and thus, the DC bias characteristics may be degraded. Further, the case in which the non-magnetic gap layers 90 are stacked while the number of non-magnetic gap layers 90 exceeds the turns amount of the coil pattern 50 may correspond to the case in which the cover layers 80*a* and 80*b* of the multi-layered body 15 are formed with the non-magnetic gap layers 90 and therefore, capacity may be degraded.

Describing one turn of the coil patterns 50 with reference to FIG. 6, when a single via electrode 72*b* is defined as 1 and another via electrode 74*b* is defined as 2 in the conductive pattern 40*b* formed on the same magnetic layer 60*b*, a via electrode 72*c* of the conductive pattern 40*c* under the stacking direction corresponding to the 2 is defined as 3, and an opposite point of the conductive pattern 40*c* of the magnetic layer 60*c* facing 1 is defined as 4, one turn (1→2→3→4) is formed in a counterclockwise direction from 1, which may be defined as one turn. When 4 is defined as 1', the next one turn (1'→2'→3'→4') may be formed.

Here, the bottom of the via electrode 74*b* of the 2 and the bottom of the via electrode 72*c* of the 3 correspond to the via electrodes 94*b* and 94*c* respectively formed on the non-magnetic gap layers 90*b* and 90*c*, such that an upper conductive pattern and a lower conductive pattern may be electrically connected to each other.

Figure 7:
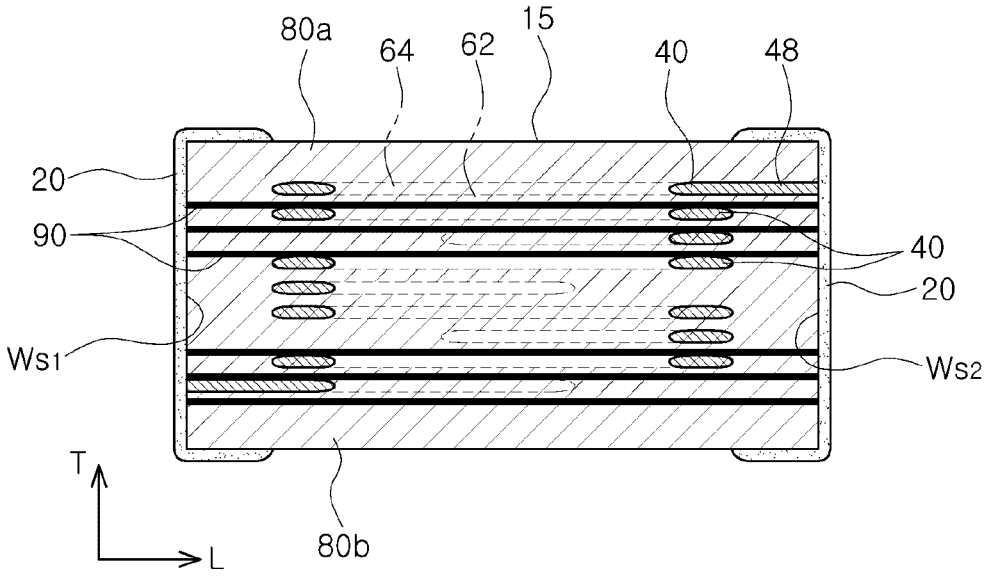
FIG. 7 is a schematic cross-sectional view taken along line VII-VII' of FIG. 1.
Figure 8:
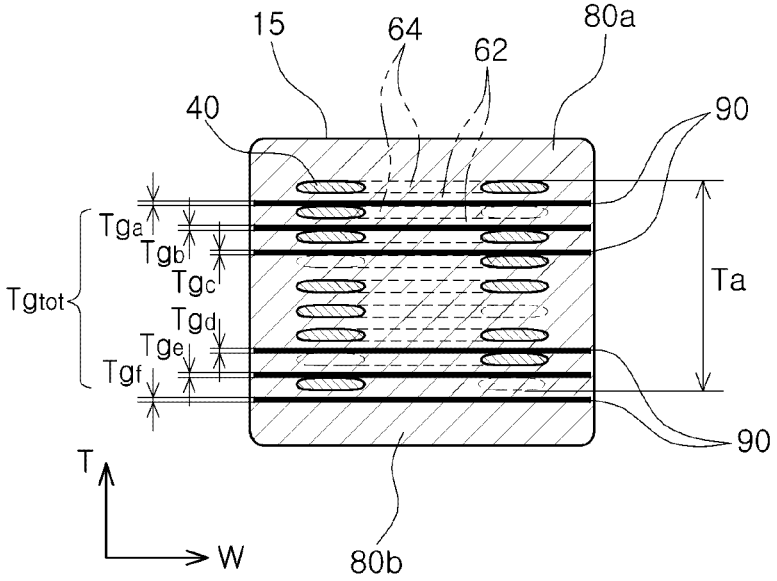
FIG. 8 is a schematic cross-sectional view taken along line VIII-VIII' of FIG. 1.

FIG. 7 is a schematic cross-sectional view taken along line VII-VII' of FIG. 1 and FIG. 8 is a schematic cross-sectional view taken along line VIII-VIII' of FIG. 1.

FIG. 7 shows that the multi-layered chip type inductor of FIG. 1 is cut in a length direction L and a thickness direction T and FIG. 8 shows that the multi-layered chip type inductor of FIG. 1 is cut in a width direction Wand a thickness direction T.

In the cross-sectional views of FIGS. 7 and 8, on the assumption that the dotted line portion indicates that the conductive patterns 40 are formed, it describes a dimension relationship such as a thickness between the conductive patterns 40 and the magnetic layers 60, and the like.

As shown in FIG. 7, when being viewed in the length direction L and the thickness direction T, leads 48 that are electrically connected to the external electrodes 20 are formed on top and bottom magnetic layers on which the conductive patterns 40 are formed. The leads 48 are exposed to short sides $W_{s1}$ and $W_{s2}$ in a length direction of the ceramic body 15 and are electrically connected to the external electrodes 20.

The conductive patterns 40 form a common layer with the first magnetic layers 64 and may be disposed to face each other within the multi-layered body 15, having the second magnetic layer 62 therebetween.

Here, the first magnetic layers 64 may be printed to have a thickness equal to that of the conductive pattern 40.

Referring to the cross section of the width direction W and the thickness direction T of FIG. 8, dimensions for describing the embodiment of the present invention are shown.

According to the embodiment of the present invention, when a thickness of an active region layer defined by forming the conductive patterns 40 in the stacking direction is defined as Ta and an overall thickness that is a sum of respective thicknesses Tga, Tgb, . . . , Tgf of the non-magnetic gap layers 90 are defined as Tg.tot, Tg,tot:Ta may satisfy $0.1 \leq Tg,tot:Ta \leq 0.5$.

When Tg,tot:Ta is less than 0.1, the thickness of the non-magnetic gap layer 90 is insufficient and thus, the DC bias characteristics may be degraded and when Tg,tot:Ta exceeds 0.5, the capacity loss may be problematic.

Here, the thickness of the non-magnetic gap layer 90 may not be completely the same for respective layers by the sintering and therefore, the thickness of the non-magnetic gap layer 90 may refer to an average thickness.

As shown in FIG. 8, the thickness of the non-magnetic gap layer 90 may be measured with images obtained by scanning the cross section in the width direction W and the thickness direction T of the multi-layered body 15 using the scanning electron microscope (SEM). For example, for any multi-layered body 15 extracted from the image obtained by scanning the cross section in the width and thickness directions W-T cut in the central portion in the length direction L of the multi-layered body 15 using the SEM, the thickness of the non-magnetic gap layers 90 is measured at thirty points having equal intervals therebetween in the width direction, and thus, an average value thereof may be obtained.

In addition, as shown in FIG. 7, the thickness of the non-magnetic gap layer 90 may be measured even by the images obtained by scanning the cross section of the length and thickness direction L-T in the central portion of the multi-layered body 15 in the width direction W thereof, using the SEM.

Here, the central portion of the width direction W or the length direction L of the multi-layered body 15 may be defined as a point within a range of 30% of the width or the length of the multi-layered body 15 from the center point of the width direction W or the length direction L of the multi-layered body 15.

Experimental Example

The multi-layered chip type inductor according to the Inventive Examples of the present invention and Comparative Examples was manufactured as follows. A plurality of magnetic green sheets, manufactured by applying a slurry including the Ni—Zu—Cu-based ferrite powder to a carrier film and drying the slurry were prepared.

Next, the conductive patterns are formed by applying a silver (Ag) conductive paste to the magnetic green sheet using a screen. In addition, the single multi-layered carrier is formed together with the magnetic green sheet by applying the ferrite slurry to the magnetic green sheet around the conductive pattern so as to be a common layer with the conductive pattern.

The stacked carriers in which the conductive patterns are formed are repeatedly multi-layered and the conductive patterns are electrically connected, thereby forming the coil pattern in the stacking direction. In addition, the non-magnetic gap layer may be formed between the conductor patterns by stacking the number of required thin non-magnetic sheets between the stacked carriers.

Here, the via electrodes are formed in the magnetic green sheet and the non-magnetic sheet to electrically connect the upper conductive pattern with the lower conductive pattern, having the magnetic green sheet and the non-magnetic sheet therebetween.

Here, the stacked carriers were multi-layered within a range of 10 layers to 20 layers, which were isostatically pressed under the pressure conditions of 1000 kgf:cm$^2$ at 85° C. The pressed chip laminate was cut in a form of an individual chip and the cut chip was subjected to a debinder process by being maintained at 230° C. for 40 hours under an air atmosphere.

Next, the chip laminate was fired under the air atmosphere at a temperature of 950° C. or less. In this case, the size of the fired chip was 2.0 mm×1.6 mm (L×W), 2016-sized.

Next, the external electrodes were formed by performing the processes, such as plating, and the like.

Here, samples of the multi-layered chip type inductor were manufactured so that the thickness Tg of the non-magnetic gap layer, the number n of non-magnetic gap layers, the thickness of all the non-magnetic gap layers to the thickness of the active layer nTg:Ta, and the turns amount of the coil pattern were variously manufactured in the cross section in the width and thickness direction W-T.

Tg and Ta were measured by performing high magnification image photographing on the cut cross section obtained by polishing the central portion of the multi-layered body 15 using an optical microscope and analyzing the photographed high magnification image using a computer program such as a SigmaScan Pro, or the like.

Hereinafter, the embodiments of the present invention will be described in more detail with reference to the experimental data of the Inventive Examples of the present invention and the Comparative Examples.

The following Table 1 shows results obtained by measuring the change in the inductance, the DC resistance, and the allowable current according to the change in Tg, the number n of Tgs, and the Ta.

TABLE 1

| Sample No. | Tg (μm) | n (Number) | nTg:Ta | Turns amount Of Coil Pattern (Number) | Inductance (With Respect To Targeted Inductance) (%) | Rdc (Ω) | Allowable Current (mA) |
|---|---|---|---|---|---|---|---|
| 1* | 0.7 | 8 | 0.091 | 8 | 143 | 105 | 140 |
| 2 | 1.1 | 8 | 0.136 | 8 | 119 | 103 | 168 |
| 3 | 2.3 | 8 | 0.247 | 8 | 108 | 110 | 185 |
| 4 | 3.5 | 8 | 0.333 | 8 | 95 | 108 | 211 |
| 5 | 5.1 | 8 | 0.417 | 8 | 87 | 106 | 230 |
| 6 | 6.9 | 8 | 0.496 | 8 | 81 | 102 | 245 |
| 7* | 8.1 | 8 | 0.536 | 8 | 75 | 109 | 267 |
| 8* | 3.5 | 3 | 0.13 | 8 | 127 | — | 145 |
| 9 | 3.5 | 4 | 0.17 | 8 | 115 | — | 172 |
| 10 | 3.5 | 5 | 0.21 | 8 | 112 | — | 179 |
| 11 | 3.5 | 6 | 0.25 | 8 | 108 | — | 185 |
| 12 | 3.5 | 8 | 0.33 | 8 | 95 | — | 211 |
| 13* | 3.5 | 10 | 0.42 | 8 | 78 | — | 262 |

*Comparative Example

Here, the inductance L was measured using an Agilent 4286A model LCR meter. Further, DC resistance was measured using an Agilent 4338B model millohm meter and the allowable current was measured by a DC bias current in which capacity is reduced to approximately 70% of an initial value in the state in which the DC bias current is applied.

Referring to Table 1, when Tg was less than 1 μm, the thickness of the gap layer was too thin. Therefore, sample 1 did not serve as the non-magnetic gap layer as is, and thus, had high initial capacity but low allowable current. When Tg exceeded 7 μm, sample 7 barely implemented capacity.

When the number of non-magnetic gap layers was less than four layers, sample 8 did not serve as the non-magnetic gap as it is due to the insufficient number of gap layers and therefore, had high initial capacity but low allowable current. When the non-magnetic gap layers are stacked, capacity may be degraded in the case that the number of non-magnetic gap layers exceeds the turns amount of the coil pattern.

When the nTg:Ta is less than 0.1, in the sample 1, the volume fraction of the non-magnetic gap layer is too small and thus, the DC bias characteristics may be degraded and when the nTg:Ta exceeds 0.5, in sample 8, the capacity loss may be problematic.

As set forth above, according to the multi-layered chip electronic component according to the embodiments of the present invention, the DC bias characteristics may be excellent while implementing the miniaturization and securing the sufficient capacity, by adjusting the thickness of the non-magnetic gap layer.

While the present invention has been shown and described in connection with the embodiments, it will be apparent to those skilled in the art that modifications and variations may be made without departing from the spirit and scope of the invention as defined by the appended claims.

What is claimed is:

1. A multi-layered chip electronic component, comprising:

a multi-layered body including a plurality of magnetic layers;

conductive patterns electrically connected in a stacking direction to form coil patterns, within the multi-layered body;

at least two non-magnetic gap layers comprising non-magnetic material formed over a laminated surface of the multi-layered body between the multi-layered magnetic layers in an upper half of the multi-layered body; and at least two non-magnetic gap layers comprising non-magnetic material formed over a laminated surface of the multi-layered body between the multi-layered magnetic layers in a lower half of the multi-layered body, the number of non-magnetic gap layers being fewer than a turns amount of the coil pattern, and wherein a plurality of magnetic layers with conductive patterns formed therein are immediately adjacent each other with no intervening non-magnetic gap layers in a center portion between the upper and lower halves in the stacking direction of the multilayered body, and the non-magnetic gap layers are formed across an entire length and width of immediately adjacent magnetic layers, and the non-magnetic material extends continuously across the entire length and width.

2. The multi-layered chip electronic component of claim 1, wherein the non-magnetic gap layer is formed of a dielectric composition.

3. The multi-layered chip electronic component of claim 1, wherein the magnetic layer includes a first magnetic layer formed to be a common layer with the conductive pattern and a second magnetic layer including via electrodes electrically connecting the conductive patterns.

4. The multi-layered chip electronic component of claim 3, wherein the first magnetic layer includes the non-magnetic gap layer.

5. The multi-layered chip electronic component of claim 3, wherein the second magnetic layer includes the non-magnetic gap layer.

6. The multi-layered chip electronic component of claim 1, wherein the non-magnetic gap layer is disposed between the conductive patterns.

7. The multi-layered chip electronic component of claim 1, wherein a length of the multi-layered body is 2.1 mm or less and a width of the multi-layered body is 1.7 mm or less.

8. The multi-layered chip electronic component of claim 1, wherein a length and a width of the multi-layered chip electronic component has a range of 2.0±0.1 mm and 1.6±0.1 mm, respectively.

9. The multi-layered chip electronic component of claim 1, wherein each non-magnetic gap layer has a thickness Tg in a range of 1 μm to 7 μm.

10. The multi-layered chip electronic component of claim 1, wherein when a thickness of an active region layer defined by forming the conductive patterns in the stacking direction is defined as Ta and the overall thickness of the non-magnetic gap layer is defined as Tg,tot, Tg,tot:Ta satisfies 0.136≤Tg,tot:Ta≤0.496.

11. A multi-layered chip electronic component, comprising:

a multi-layered body including a plurality of magnetic layers;

conductive patterns disposed between the plurality of magnetic layers and electrically connected in a stacking direction to form coil patterns;

at least two non-magnetic gap layers comprising non-magnetic material formed over a laminated surface of the multi-layered body between the multi-layered magnetic layers in an upper half of the multi-layered body; and at least two non-magnetic gap layers comprising non-magnetic material formed over a laminated surface of the multi-layered body between the multi-layered magnetic layers in a lower half of the multi-layered body, wherein a plurality of magnetic layers and conductive patterns are immediately adjacent each other in a center portion between the upper and lower halves in the stacking direction with no intervening non-magnetic gap layers, and the non-magnetic gap layers are formed across an entire length and width of immediately adjacent magnetic layers, and the non-magnetic material extends continuously across the entire length and width.

12. The multi-layered chip electronic component of claim 11, wherein the number of non-magnetic gap layers is fewer than the turns amount of the coil pattern.

13. The multi-layered chip electronic component of claim 11, wherein the non-magnetic gap layer is formed over a laminated surface of the multi-layered body.

14. The multi-layered chip electronic component of claim 11, wherein the non-magnetic gap layer is formed over a laminated surface of the multi-layered body and the number of non-magnetic gap layers is four layers or more.

15. The multi-layered chip electronic component of claim 11, wherein the non-magnetic gap layer is formed of a dielectric composition that suppresses a diffusion of a component of the magnetic layer.

16. The multi-layered chip electronic component of claim 15, wherein the dielectric composition includes one or more composition selected from $TiO_2$, $ZrO_2$, $Al_2O_3$, and $ZnTiO_3$.

17. The multi-layered chip electronic component of claim 11, wherein the magnetic layer includes a first magnetic layer formed to be a common layer with the conductive pattern and a second magnetic layer including via electrodes electrically connecting the conductive patterns.

18. The multi-layered chip electronic component of claim 11, wherein the first magnetic layer includes the non-magnetic gap layer.

19. The multi-layered chip electronic component of claim 11, wherein the second magnetic layer includes the non-magnetic gap layer.

20. The multi-layered chip electronic component of claim 11, wherein the non-magnetic gap layer is disposed between the conductive patterns.

21. The multi-layered chip electronic component of claim 11, wherein each non-magnetic gap layer has a thickness Tg in a range of 1 μm to 7 μm.

22. The multi-layered chip electronic component of claim 11, wherein when a thickness of an active region layer defined by forming the conductive patterns in the stacking direction is defined as Ta and the overall thickness of the non-magnetic gap layer is defined as Tg,tot, Tg,tot:Ta satisfies 0.136≤Tg,tot:Ta≤0.496.

* * * * *